US010154735B2

(12) United States Patent
Poveda Rosa

(10) Patent No.: US 10,154,735 B2
(45) Date of Patent: Dec. 18, 2018

(54) BED OR HAMMOCK

(71) Applicant: Salvador Jose Poveda Rosa, Valencia (ES)

(72) Inventor: Salvador Jose Poveda Rosa, Valencia (ES)

( * ) Notice: Subject to any disclaimer, the term of this patent is extended or adjusted under 35 U.S.C. 154(b) by 0 days.

(21) Appl. No.: 15/580,445

(22) PCT Filed: Jan. 30, 2017

(86) PCT No.: PCT/ES2017/070051

§ 371 (c)(1),
(2) Date: Dec. 7, 2017

(87) PCT Pub. No.: WO2018/069556

PCT Pub. Date: Apr. 19, 2018

(65) Prior Publication Data

US 2018/0295999 A1 Oct. 18, 2018

(51) Int. Cl.

| | |
|---|---|
| ***A47C 17/64*** | (2006.01) |
| ***A47C 19/20*** | (2006.01) |
| ***A45F 3/24*** | (2006.01) |
| ***A47D 7/00*** | (2006.01) |
| ***A47C 19/00*** | (2006.01) |

(52) U.S. Cl.
CPC ..... *A47C 17/645* (2013.01); *A45F 3/24* (2013.01); *A47C 19/005* (2013.01); *A47C 19/202* (2013.01); *A47D 7/005* (2013.01)

(58) Field of Classification Search
CPC ..... A47C 17/64; A47C 19/00
USPC ..... 5/110–114
See application file for complete search history.

(56) References Cited

U.S. PATENT DOCUMENTS

| | | | | |
|---|---|---|---|---|
| 6,701,548 | B2 * | 3/2004 | Vigneron | A47C 19/202 5/110 |
| 7,086,100 | B1 | 8/2006 | Lo | |
| D787,873 | S * | 5/2017 | Rolla | D6/718 |

(Continued)

FOREIGN PATENT DOCUMENTS

| | | |
|---|---|---|
| EP | 1155642 | 11/2001 |
| EP | 1312283 | 5/2003 |
| ES | 2267484 | 3/2007 |

OTHER PUBLICATIONS

International Search Report and Written Opinion of corresponding PCT Application No. PCT/ES2017/070051, dated Jul. 7, 2017.

*Primary Examiner* — Fredrick C Conley
(74) *Attorney, Agent, or Firm* — Gardner Linn

(57) ABSTRACT

The present invention relates to a bed or hammock which comprises four support legs delimiting two longitudinal sides between them, each one of which has longitudinal bars, and two transverse sides which are shorter in length than, and perpendicular to, the previously mentioned sides, a surface element made up of a fabric, mesh, canvas or similar material arranged between the support legs, wherein the legs are made up of a body which comprises lateral faces perpendicular to the side they delimit, respectively, outer faces parallel to the side they delimit, respectively, and an upper face, wherein each longitudinal and transverse bar is fastened to a pair of legs, respectively, by fastening means, and wherein the invention comprises a fastening and/or tensioning device for the surface element on at least one of the longitudinal sides and/or transverse sides.

20 Claims, 5 Drawing Sheets

(56) References Cited

U.S. PATENT DOCUMENTS

| | | | | |
|---|---|---|---|---|
| 2003/0088914 | A1* | 5/2003 | Vigneron | A47C 19/202 5/8 |
| 2016/0100693 | A1* | 4/2016 | Urban | A47D 7/00 5/8 |

* cited by examiner

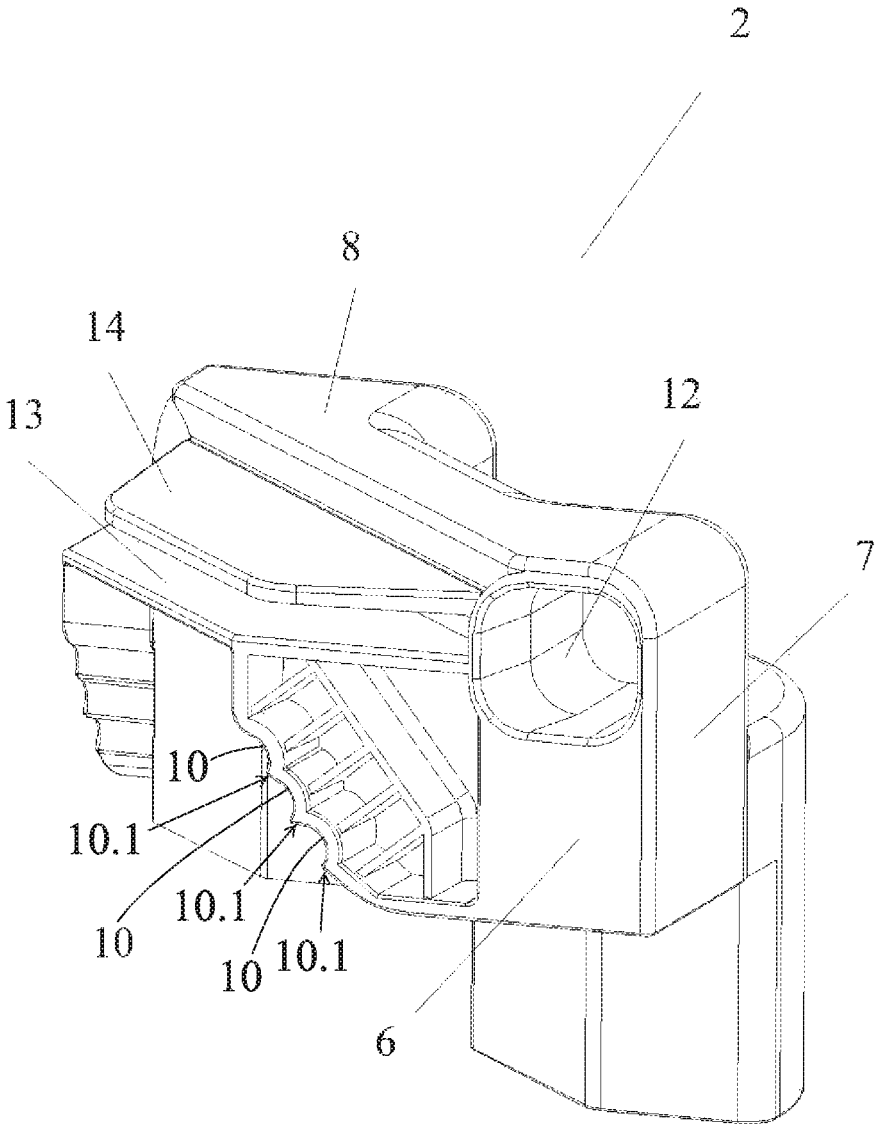
Fig. 1.1

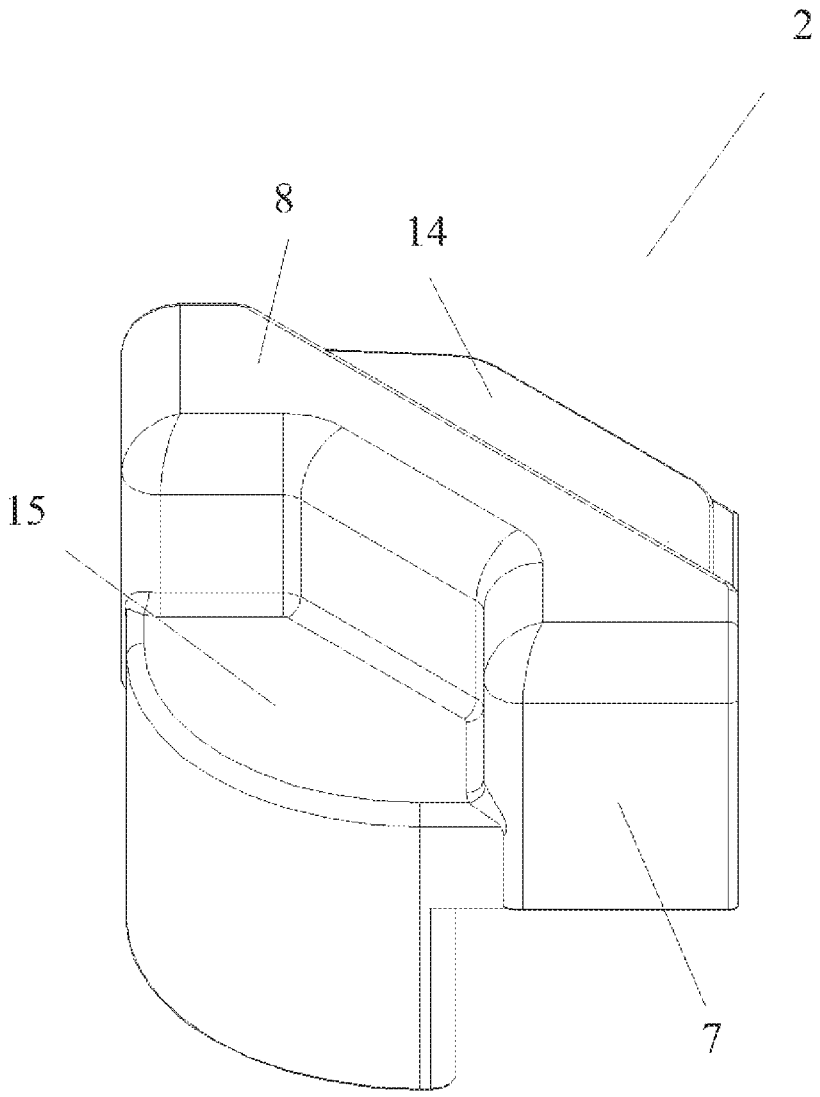
Fig. 1.2

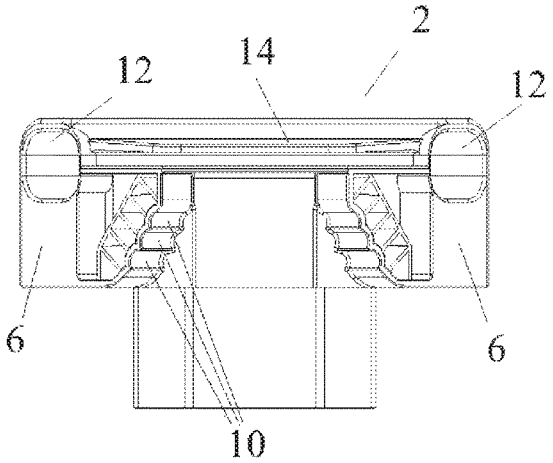
Fig. 2.2
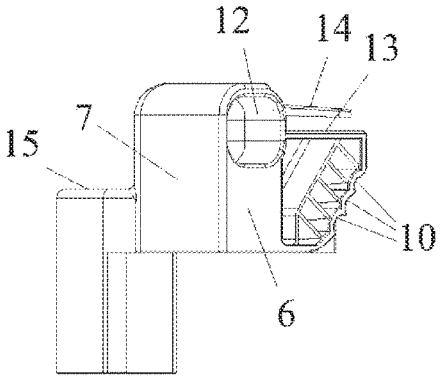
Fig. 2.3
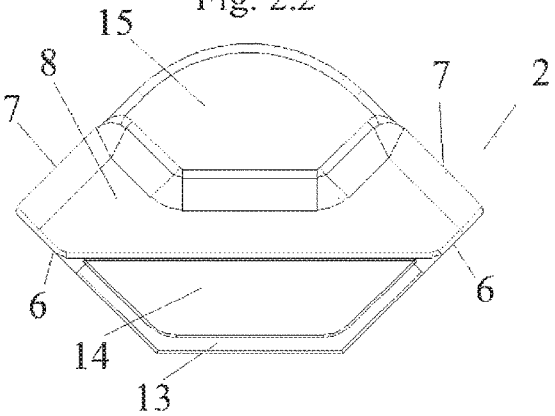
Fig. 2.1

BED OR HAMMOCK

CROSS REFERENCE TO RELATED APPLICATIONS

The present application is a § 371 national stage of International Application PCT/SE2017/070051, filed Jan. 30, 2017, which claims priority benefit of Spanish Pat. Application Ser. No. ES U201631226, filed Oct. 14, 2016, both of which are hereby incorporated herein by reference in their entireties.

TECHNICAL FIELD OF THE INVENTION

The present invention relates to the technical field of beds or hammocks, specifically to a bed or hammock with at least four support legs at the corners thereof, with two longitudinal bars, two transverse bars, and a surface element made up of a fabric, mesh, canvas or similar material arranged between the legs.

BACKGROUND OF THE INVENTION

Nowadays there is a wide variety of beds or hammocks, all designed to allow a person to rest in specific conditions.

One of these types of beds or hammocks is made up of a fabric, mesh, canvas or similar material for supporting the user and allowing them to rest, which is placed between longitudinal and transverse bars and tightened to a greater or lesser degree and arranged between at least four legs, located at the corners of the bed or hammock.

They are often used in places where space is limited and beds and hammocks are needed for several users, such as in hostels, shelters and, above all, in primary schools and nursery schools in order to provide a place for young children to rest.

Therefore, it is necessary for these types of beds or hammocks to have basic characteristics, such as comfort, safety, durability and easy of assembly, as well as a simple system for stacking the same.

In the state of the art there are beds or hammocks of this type. Specifically, and by way of example, the document with reference number ES2267484 may be referred to.

This document defines a stackable bed leg, the hammock made up of a set of legs, between which tubes are arranged to support a mesh which forms the base of the hammock. The leg has an upper area for supporting a similar leg from another hammock when stacked, having an essentially triangular configuration from a plan view. The leg comprises a depression or hole with a cross section essentially equal to the cross section of the leg.

This leg makes the hammock stackable, such that it facilitates the support of one hammock on top of the other, preventing them from sliding. Moreover, there is a leg that ensures safety from accidents, since it has an area for supporting the canvas of the hammock, which prevents children from accidentally inserting a body part.

However, it does have some aspects which could be improved, such as the fact that in this type of hammock, the fabric, mesh, canvas, or similar material, which serves as a support for the user, has a fixed tension which is not adjustable and, therefore, it is not possible to adapt the tension to a lesser or greater degree depending on the needs, weight or preferences of the user. It may also be necessary to provide tension due to a loss of the same as a result of continued use of the hammock and the disadvantage with this type of hammock is that this is not possible.

Likewise, another aspect which could be improved is the fact that the longitudinal and transverse bars are secured to the legs by means of the adjustment thereof in a hole and a fastening screw. This is neither comfortable nor practical since it makes the assembly and disassembly of the hammock complicated.

In addition, the beds or hammocks comprised in the state of the art normally require specific tools and qualified personnel, given that they are usually assembled in a factory. Therefore, the possibility of the final user being the one to quickly assembly or disassemble the bed or hammock according to their needs, or substituting any of the integral parts, such as the legs, bars or surface element is not taken into consideration.

SUMMARY OF THE INVENTION

The bed or hammock presented herein comprises at least four support legs located at the corners thereof and a surface element made up of a flexible sheet or panel of fabric, mesh, canvas or similar material arranged between the support legs. The legs delimit two longitudinal sides of the bed or hammock between them, each one of which has longitudinal bars, and two transverse sides which are shorter in length than, and perpendicular to, the previously mentioned sides, each one of which has transverse bars.

The legs of the bed or hammock are made up of a body which comprises side faces perpendicular to the side they delimit, respectively, outer faces parallel to the side they delimit, respectively, and an upper face. Likewise, each longitudinal and transverse bar is fastened to a pair of legs, respectively, by fastening means.

Furthermore, this bed or hammock comprises a fastening and/or tensioning device for the surface element on at least one of the longitudinal and/or transverse sides. The surface element is optionally made of an elastic material, such as polyester.

The fastening and/or tensioning device comprises a rod secured to the surface element at the edge of the same, corresponding to the side by fastening means, wherein the rod has two opposite ends and a length greater than the distance between the facing lateral faces of the two legs that delimit the side.

Likewise, it comprises at least one housing arranged on the facing lateral face of both legs that delimit the side, wherein each housing is suitable for housing one of the ends of the rod.

In turn, the bar fastened to both legs which delimit the side is located in a position closer to the outer face of the legs than the at least one housing.

According to one embodiment, the length of the surface element in a direction perpendicular to the side is such that the edge of the surface element may wrap around the bar of the side by the outer perimeter thereof.

According to another aspect, the body of the leg comprises at least two housings, and optionally three housings, arranged at different heights and inclined with respect to the outer face of the same.

According to another embodiment, the at least one housing is concave.

In yet another embodiment, the at least one housing comprises a flange or protrusion in order to prevent the rod from accidentally coming out of its housing.

According to another aspect, the fastening means for fastening the rod to the edge of the surface element are made up of a fold of the edge joined by high frequency welding, wherein the rod is inserted inside the fold.

In still another embodiment, the longitudinal and transverse bars have a square cross section with rounded edges. Optionally, the bars are made of aluminum.

According to a further embodiment, the body of the legs is symmetric with respect to a vertical plane.

In another embodiment, the upper face comprises a first depression for supporting a leg of another bed or hammock when they are stacked.

According to another embodiment, the surface element has a rectangular shape with four chamfers on the corners thereof and the upper face of the legs comprises a fitting area for a chamfer of the surface element, wherein the fitting area is made up of a second depression which has the same angle as the chamfer with respect to the two outer faces of the leg, located in the area of the leg farthest from both outer faces, and a safety piece with the same shape as the second depression and arranged parallel on the same at a distance such that it may enable the fitting of the chamfer of the surface element between both.

In another embodiment, the fastening means for each longitudinal and transverse bar comprise fastening holes suitable for a press fitting of one end of the bar, respectively, wherein the fastening holes are located on the facing lateral faces of the pair of legs to which the bar is fastened, on the upper corner of the lateral faces closest to the outer face of the leg.

The bed or hammock that is presented herein significantly improves upon the state of the art.

This is due to the fact that a bed or hammock is achieved in which the tension of the fabric, canvas, mesh or similar material may be quickly and easily modified by the user with a simple device at any moment it is required.

This device can be applied to just one of the sides of the bed or hammock, in which case it would apply tension in one single direction, to two sides of the same, either parallel or perpendicular, or even to three or four sides, in order to provide a perfect tension from all four sides.

Thus, the user has the option to tense the mesh depending the use, weight, preferences or needs whenever it may be necessary.

The invention further allows for the assembly and disassembly of the longitudinal and transverse bars of the bed or hammock in a quick and easy way without the need for screw elements, specific tools, or qualified personnel.

Another advantage of this bed or hammock is the safety it provides with respect to possible accidents due to the accidental insertion of any body parts of a child in the parts of the device, given that, in addition to the second depression for the placement of the chamfer of the mesh in order to avoid holes, there is a safety piece which hides the chamfer of the mesh, increasing safety and preventing accidents.

It is therefore a bed or hammock that is highly practical and efficient, in addition to being very easy to use and comfortable, thanks to the possibility of adjusting the tension.

These and other objects, advantages and features of the invention will become apparent upon review of the following specification in conjunction with the drawings.

BRIEF DESCRIPTION OF THE DRAWINGS

For the purpose of helping to make the characteristics of the invention more readily understandable, in accordance with a practical embodiment thereof, the description is accompanied by a set of drawings constituting an integral part thereof which, by way of illustration and not limitation, represent the following:

FIGS. 1.1 and 1.2. respectively show a perspective view from two opposite points of view of a leg of the bed or hammock for an embodiment of the invention.

FIGS. 2.1, 2.2 and 2.3 respectively show the top plan, elevation and profile views of a leg of the bed or hammock, for an embodiment of the invention.

DETAILED DESCRIPTION OF THE PREFERRED EMBODIMENT

Figure 3:
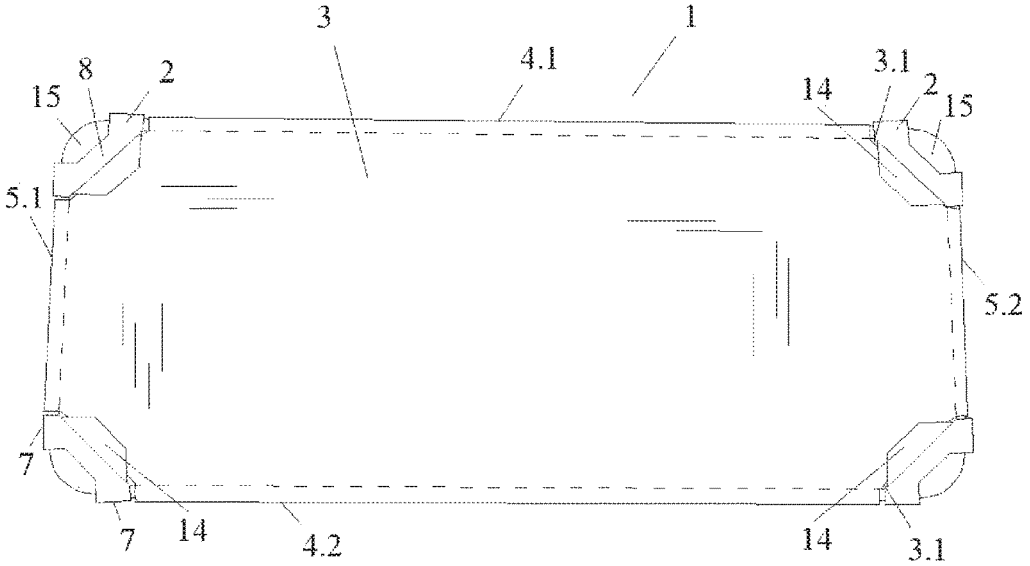
FIG. 3. shows a top view of bed or hammock, for an embodiment of the invention.

With reference to the figures provided, it may be observed how in an embodiment of the invention, the hammock 1 presented herein comprises four support legs 2 located at the corners thereof and a surface element 3 made up of a canvas or similar flexible sheet or panel material arranged between the support legs 2. As can be seen in FIG. 3, these legs 2 delimit two longitudinal sides 4.1, 4.2 between them, each one of which has longitudinal bars 11, and two transverse sides 5.1, 5.2 which are shorter in length than, and perpendicular to, the previously mentioned sides, each one of which has transverse bars 11.

As shown in FIGS. 1.1 to 2.2, the legs 2 of the hammock 1 are made up of a body which comprises lateral faces 6 perpendicular to the side they delimit, respectively, outer faces 7 parallel to the side they delimit, respectively, and an upper face 8. Likewise, each longitudinal and transverse bar 11 is fastened, respectively, to a pair of legs 2 by fastening means.

The hammock 1 proposed herein further comprises a fastening and/or tensioning device for the surface element 3 on at least one of the longitudinal 4.1, 4.2 and/or transverse sides 5.1, 5.2. In this embodiment of the invention, the device is on one of the transverse sides 5.1.

Figure 4:
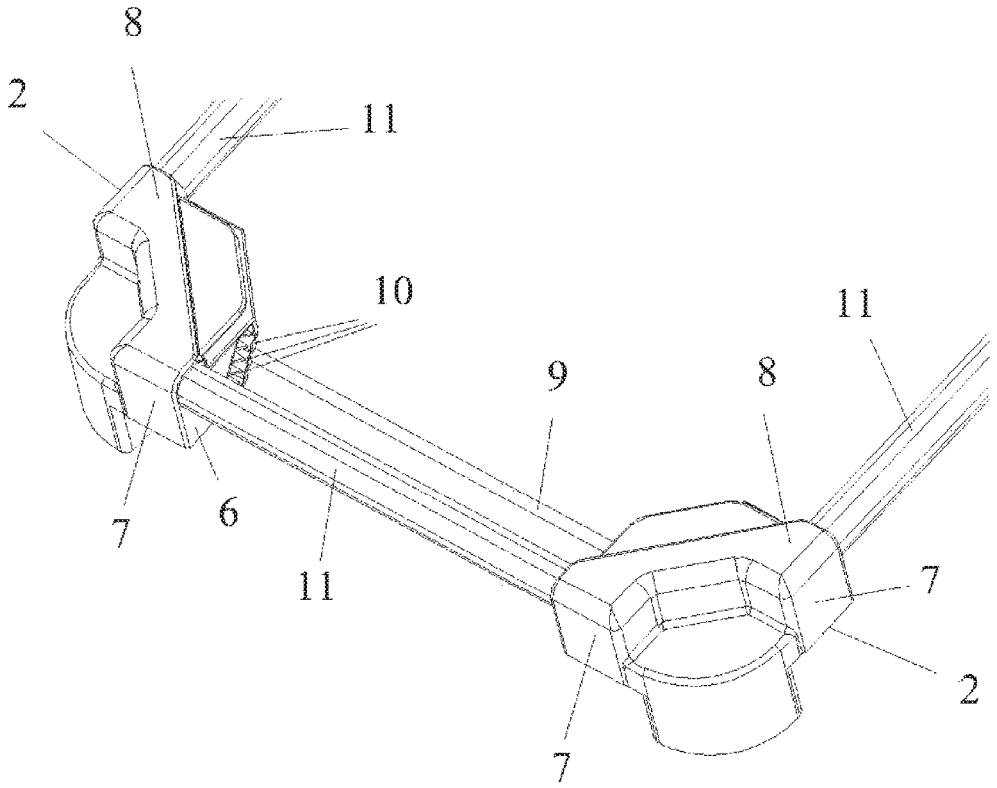
FIG. 4. shows a perspective view of an end of the bed or hammock, without the surface element, for an embodiment of the invention.

As shown in FIG. 4, the fastening and/or tensioning device comprises a rod 9 fastened to the surface element 3 on the edge of the same which corresponds to the transverse side 5.1, wherein the device is located by fastening means. The rod 9 has two opposite ends and a length greater than the length between the facing lateral sides 6 of the two legs 2 which delimit the transverse side 5.1.

As can be seen in FIGS. 1.1, 2.2 and 2.3, the fastening and/or tensioning device further comprises at least one housing 10 arranged on the facing lateral face 6 of both legs 2 which delimit the lateral side 5.1, wherein each housing 10 is suitable for housing one of the ends of the rod 9.

In this embodiment of the invention, as shown in the figures, the body of the leg 2 comprises three housings 10 arranged at different heights and inclined with respect to the outer face 7 of the same.

Likewise, the bar 11 fastened to both legs 2 which delimit the transverse side 5.1 is located in a position closer to the outer face 7 of the legs 2 than the at least one housing 10.

In this embodiment of the invention, the length of the surface element 3 in a perpendicular direction to the transverse side 5.1 that the fastening and/or tensioning device has is such that the edge of the surface element 3 may wrap around the bar 11 of the transverse side 5.1 by the outer perimeter thereof.

In this way, when one wants to adjust the tension of the surface element 3, the element is stretched from the rod 9 located on the edge which corresponds to the transverse side 5.1 and is wrapped around the outside of the transverse bar 11 fastened to the two legs 2 which delimit the transverse side 5.1. The ends of the rod 9 are then fitted in one of the three housings 10 present on the facing lateral faces 6 of the legs 2, specifically in the one that provides the desired tension, taking into consideration that the tension provided to the surface element 3 is greater when the ends of the rod 9 are fitted in the respective housings 10 farthest from the outer face 7 of the legs 2. That is to say, in this embodiment, this would be in the housings 10 arranged on the upper level.

In this embodiment of the invention, the fastening means for each longitudinal and transverse bar 11 comprise fastening holes 12 suitable for the press fitting of an end of the bar 11, respectively. These fastening holes 12 are located on the facing lateral faces 6 of the pair of legs 2 to which the bar is fastened 11, on the upper corner of the lateral faces 6 closest to the outer face 7 of the leg 2. In this way, with regard to the bar 11 arranged on the transverse side 5.1 with the fastening and/or tensioning device, given that the bar 11 is fastened at that location, closer to the outer face 7 of the leg 2, it allows the surface element 3 to wrap around it and the bar 11 to assist in the tensioning of the same.

In this embodiment of the invention, the three housings 10 of each lateral face 6 of the leg 2 are concave in order to facilitate the insertion of the rod 9, and comprise a fastening flange (10.1) for the end of the rod 9, so as to prevent it from becoming undone from its position of use.

Likewise, in this embodiment of the invention, the fastening means for fastening the rod 9 to the edge of the surface element 3 are made up of a fold of the edge joined by high frequency welding, where the rod 9 is inserted inside the fold.

The longitudinal and transversal bars 11 which form this hammock 1 have a square cross section with rounded edges and are made of aluminum, which is lighter than other materials, such as galvanized iron.

As can be seen in FIGS. 2.1 and 2.2, the body of the legs 2 is symmetric with respect to a vertical plane.

In this exemplary embodiment, the upper face 8 comprises a first depression 15 for supporting a leg of another hammock, which makes it possible to stack several hammocks.

In this embodiment of the invention, the surface element 3, as shown in FIG. 3, has a rectangular shape with four chamfers 3.1 at the corners thereof. In turn, the upper face 8 of the legs 2 comprises a fitting area for a chamfer 3.1 of the surface element 3, respectively.

As shown in FIGS. 1.1 and 2.3, this fitting area is made up of a second depression 13 and a safety piece 14. The second depression 13 has the same angle as the chamfer 3.1, with respect to the two outer faces 7 of the leg, and is located in the area of the same, farthest from both outer faces 7, while the safety piece 14 has the same shape as the second depression 13 and is arranged parallel on the same at a distance such that it allows for the fitting of the chamfer 3.1 of the surface element 3 between both.

This safety piece 14 acts as a visor which prevents the accidental insertion of a body part of a child into this area.

The embodiment described constitutes only one example of the present invention, and therefore the specific details, terms and phrases used in the present specification should not be considered as limiting, but rather shall be understood merely as a basis for the claims and as a representative basis which provides a comprehensible description as well as sufficient information for any person skilled in the art to apply the present invention.

The bed or hammock that is presented herein significantly improves upon the state of the art.

The result is, therefore, a hammock which may be quickly and easily assembled, due to the fact that it does not require screw elements in the process.

The fastening and/or tensioning device is very advantageous, given that it allows the tension of the surface element to be adjusted to meet the needs, preferences, weight, uses, etc., of the user. This device is easy for the user to use in that it allows the user to quickly use and/or adjust it whenever necessary, without needing to depend on any qualified personnel.

Moreover, the result is a very safe hammock for children, since the dangerous areas, such as the fastening of the chamfer of the surface element to the leg, are protected such that it prevents any type of accident.

It is therefore a very safe, practical and efficient hammock, in addition to being simple to manage and easily stackable.

The invention is not limited to the embodiment(s) described herein but can be amended or modified without departing from the scope of the present invention, which is intended to be limited only by the scope of the appended claims as interpreted according to the principles of patent law including the doctrine of equivalents.

The invention claimed is:

1. A bed or hammock comprising:

at least four support legs located at respective corners of the bed or hammock, wherein the four support legs delimit two longitudinal sides between them, each longitudinal side having a longitudinal bar, and two transverse sides that are shorter in length than, and perpendicular to, the two longitudinal sides, each of the transverse sides having a transverse bar, and a surface element made up of a flexible sheet or panel material arranged between the support legs;

wherein each of the support legs comprises a body having lateral faces perpendicular to the respective longitudinal and lateral sides delimited by the respective body, outer faces parallel to the respective longitudinal and lateral sides delimited by the respective body, and an upper face;

wherein each of the longitudinal and transverse bars is fastened, respectively, to a pair of the support legs;

a fastening and tensioning device for the surface element on at least one of the longitudinal sides or at least one of the transverse sides, wherein the fastening device comprises:

a rod secured to an edge portion of the surface element corresponding to the lateral side, wherein the rod has two opposite ends and a length greater than the distance between the lateral faces of the two legs that delimit the corresponding lateral side; and a housing arranged at each of the lateral faces of the two legs that delimit the corresponding lateral side, wherein each housing is configured for receiving one of the ends of the rod;

wherein the transverse bar fastened to both legs that delimit the lateral side is located at a position closer to the respective outer faces of the legs than to the respective housing.

2. The bed or hammock according to claim 1, wherein each body comprises fastening holes suitable for the press fitting of respective ends of the longitudinal and transverse bars, wherein the fastening holes are located on respective facing lateral faces of a pair of the bodies to which the respective bar is fastened, on the upper corner of the lateral faces closest to the outer face of the respective body.

3. The bed or hammock according to claim 1, wherein the body of the leg comprises at least two housings arranged at different heights and inclined with respect to the respective outer faces.

4. The bed or hammock according to claim 1, wherein the at least one housing is concave.

5. The bed or hammock according to claim 1, wherein the at least one housing comprises a fastening flange configured to engage the end of the rod.

6. The bed or hammock according to claim 1, wherein the surface element comprises a fold at the edge portion, wherein the fold is secured by high frequency welding, and wherein the rod is inserted inside the fold.

7. The bed or hammock according to claim 1, wherein the longitudinal and transverse bars each have a square cross section with rounded edges.

8. The bed or hammock according to claim 1, wherein the longitudinal and transverse bars are made of aluminum.

9. The bed or hammock according to claim 1, wherein the body of each of the support legs is symmetric with respect to a vertical plane.

10. The bed or hammock according to claim 1, wherein the upper face comprises a first depression for supporting a leg of another bed or hammock.

11. The bed or hammock according to claim 1, wherein the surface element has a generally rectangular shape with four chamfers on the corners thereof and the upper faces of the respective bodies each define a fitting area for a respective one of the chamfers of the surface element, wherein the fitting area defines a second depression which has the same angle as the chamfer with respect to the two outer faces of the leg, located in the area of the leg farthest from both outer faces, and a safety piece with a generally corresponding shape as the second depression and arranged parallel to the second depression at a distance such that the chamfer of the surface element fits between the safety piece and the second depression.

12. The bed or hammock according to claim 1, wherein the length of the surface element in a perpendicular direction to the lateral side is such that the edge portion of the surface element is configured to wrap around the lateral bar of the corresponding lateral side by the outer perimeter thereof.

13. The bed or hammock according to claim 12, wherein the body of the leg comprises at least two housings arranged at different heights and inclined with respect to the respective outer faces.

14. The bed or hammock according to claim 13, wherein the body of each of the support legs is symmetric with respect to a vertical plane.

15. The bed or hammock according to claim 14, wherein each body comprises fastening holes suitable for the press fitting of respective ends of the longitudinal and transverse bars, wherein the fastening holes are located on respective facing lateral faces of a pair of the bodies to which the respective bar is fastened, on the upper corner of the lateral faces closest to the outer face of the respective body.

16. The bed or hammock according to claim 15, wherein the upper face comprises a first depression for supporting a leg of another bed or hammock.

17. The bed or hammock according to claim 16, wherein the surface element comprises a fold at the edge portion, wherein the fold is secured by high frequency welding, and the rod is inserted inside the fold, wherein the surface element has a generally rectangular shape with four chamfers on the corners thereof and the upper faces of the respective bodies each define a fitting area for a respective one of the chamfers of the surface element, wherein the fitting area defines a second depression which has the same angle as the chamfer with respect to the two outer faces of the leg, located in the area of the leg farthest from both outer faces, and a safety piece with a generally corresponding shape as the second depression and arranged parallel to the second depression at a distance such that the chamfer of the surface element fits between the safety piece and the second depression.

18. The bed or hammock according to claim 14, wherein the upper face comprises a first depression for supporting a leg of another bed or hammock.

19. The bed or hammock according to claim 13, wherein the surface element comprises a fold at the edge portion, wherein the fold is secured by high frequency welding, and wherein the rod is inserted inside the fold.

20. The bed or hammock according to claim 19, wherein the surface element has a generally rectangular shape with four chamfers on the corners thereof and the upper faces of the respective bodies each define a fitting area for a respective one of the chamfers of the surface element, wherein the fitting area defines a second depression which has the same angle as the chamfer with respect to the two outer faces of the leg, located in the area of the leg farthest from both outer faces, and a safety piece with a generally corresponding shape as the second depression and arranged parallel to the second depression at a distance such that the chamfer of the surface element fits between the safety piece and the second depression.

* * * * *